United States Patent [19]

Okamoto et al.

[11] Patent Number: 4,799,058

[45] Date of Patent: Jan. 17, 1989

[54] DRIVING APPARATUS FOR A GAS DISCHARGE DISPLAY PANEL

[75] Inventors: Yukio Okamoto, Sagamihara; Shinichi Shinada, Kokubunji; Kenkichi Suzuki, Mobara; Akihiko Kougami, Kokubunji, all of Japan

[73] Assignee: Hitachi, Ltd., Tokyo, Japan

[21] Appl. No.: 791,758

[22] Filed: Oct. 28, 1985

[30] Foreign Application Priority Data

Oct. 31, 1984 [JP] Japan ..... 59-227731
Dec. 17, 1984 [JP] Japan ..... 59-264472
May 29, 1985 [JP] Japan ..... 60-114079

[51] Int. Cl.[4] ..... G09G 3/28

[52] U.S. Cl. ..... 340/811; 340/758; 340/771; 315/169.4

[58] Field of Search ..... 340/758, 771, 776, 791, 340/805, 811; 315/169.1, 169.4; 358/169

[56] References Cited

U.S. PATENT DOCUMENTS 4,110,663 8/1978 Migazaki et al. ..... 315/169.4
4,581,612 4/1986 Jones ..... 340/791

OTHER PUBLICATIONS

"A New dc PDP with Low Voltage Drive and High Resolution" Proceedings of the SID, vol. 23/3, 1982 by Y. Amano, et al. pp. 169–174.

*Primary Examiner*—Gerald L. Brigance
*Assistant Examiner*—Jeffery A. Brier
*Attorney, Agent, or Firm*—Kenyon & Kenyon

[57] ABSTRACT

A driving apparatus for a gas discharge display panel having a plurality of cathodes and a plurality of anodes arranged in a matrix includes a cathode pulse generator and an anode pulse generator, with the anode pulse generator generating negative display anode pulses made up of auxiliary discharge pulses (width=tS) and display pulses of smaller pulse width (width=tD, tD≦tS) corresponding to information display signals. The anode pulse generator preferably also provides positive display anode pulses so that selection between negative and positive display anode pulses is possible.

6 Claims, 9 Drawing Sheets

| INPUT 1 | INPUT 2 | OUTPUT |
|---|---|---|
| 0 | 0 | 0 |
| 0 | 1 | 1 |
| 1 | 0 | 1 |
| 1 | 1 | 0 |

DRIVING APPARATUS FOR A GAS DISCHARGE DISPLAY PANEL

BACKGROUND OF THE INVENTION

This invention relates to a driving apparatus for a gas discharge display panel for displaying characters and figures by use of gas discharge.

A gas discharge display panel is already commonly known from the disclosure of, for example, a paper entitled "A NEW dc PDP WITH LOW VOLTAGE DRIVE AND HIGH RESOLUTION", Amano et al, Proceedings of the SID, Vol. 23/3, 1982, pp. 169–174. This panel has, however, been disadvantageous in that it has a structure which requires many driving circuits.

A patent application relating to a display panel which solves the problem is now pending (Ser. No. 684,298) and is assigned to the same assignee as the present invention. This new type panel comprises, as shown in FIG. 1, a plurality of parallel cathodes 20 arranged on a substrate 10 and connected by polyphase wiring 21, a plurality of parallel barriers 30 disposed on the cathodes 20 in such a manner as to cross the cathodes at right angles, and a plurality of parallel anodes 50 disposed on a transparent face plate 40 in parallel with the barriers 30. Flourescent areas 60 are also disposed on the face plate 40 for color display. The substrate 10 and the face plate 40 thus prepared are then put together to form a display panel.

FIG. 2 shows the connection between electrodes and terminals of the panel. The cathodes 20 (K1, K2, K3 . . . KN) are connected in four phases to respective cathode terminals K$\phi$1–K$\phi$4. The anode 50 is connected to an anode terminal A through a resistor r. A reset electrode RE for the panel is disposed on the side of the parallel cathodes 20. A pair of keep-alive electrodes are disposed adjacent to the reset electrode RE to ensure reliable operation of the panel.

FIG. 3 shows pulses that are applied to each electrode. A reset pulse (width=tR, amplitude=VR, period=T) is applied to terminal R of FIG. 2 which is connected to the reset electrode RE. Cathode pulses (width=tK, amplitude=VK, period=4tK) are applied to the cathode terminals K$\phi$1–K$\phi$4 in time sequence, the phases of which are shifted a period tK with respect to each other. Anode pulses which are composed of auxiliary discharge pulses (width=tS', amplitude=VA, period=tK) and display pulses (width=tD' amplitude=VA, period=tK) are applied to the anode terminal A in synchronism with the cathode pulses, as shown in FIG. 3. The auxiliary discharge pulses are continuous scanning pulses for self-scanning driving and the display pulses correspond to an information display signal.

As a result of its structure, this new type panel has the advantage of reducing driving circuits.

However, the pulse width tS' of the auxiliary discharge pulses must be kept at a larger size when the panel is driven with the pulses as shown in FIG. 3, because the panel can not operate stably with small auxiliary discharge pulses. Therefore, the ratio (BD/BS) of display luminance BD to the back-light BS, that is, a contrast ratio (BD/BS$\alpha$tD'/tS') drops eventually and visibility also drops.

SUMMARY OF THE INVENTION

It is an object of the present invention to provide an improved driving apparatus for a gas discharge display panel which has good visibility.

A first method for obtaining a good visibility is to increase the contrast ratio. In orer to increase the contrast ratio, the present invention adopts a negative display method instead of a positive one for the information display pattern. The negative display means that the part of the display corresponding to the information display signal emits light with low luminance and the other part with high luminance, and positive display means that the part of the display corresponding to the information display signal emits light with high luminance, the other part with low luminance. The negative display pattern may be obtained by inverting the positive one. It will be explained later why the negative display can increase the contrast ratio.

A second method for obtaining a good visibility is to be able to freely select one of the positive and negative display patterns, because it may be difficult to predict which of the positive and negative displays will be easier to view. It depends, for example, upon the environment in which the panel is placed, e,g., with dark or bright background, or upon the people who view the panel. Therefore, the present invention also provides a driving apparatus that can change over between positive and negative displays.

DESCRIPTION OF THE PREFERRED EMBODIMENT

Figure 4A:
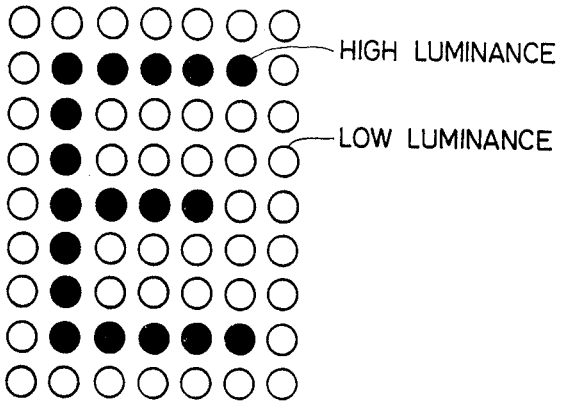
FIGS. 4A and 4B are examples showing positive and negative display patterns, respectively.
Figure 4B:
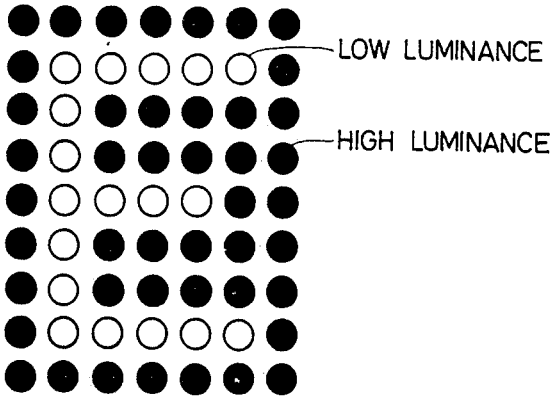

FIGS. 4A and 4B show display patterns of a character "E" on the panel. FIG. 4A shows the positive display pattern, in which the information display signal emits light with high luminance (black circle marks in FIG. 4A), and FIG. 4B shows the negative display pattern, in which the information display signal emits light with low luminance (white circle marks in FIG. 4B).

Figure 3:
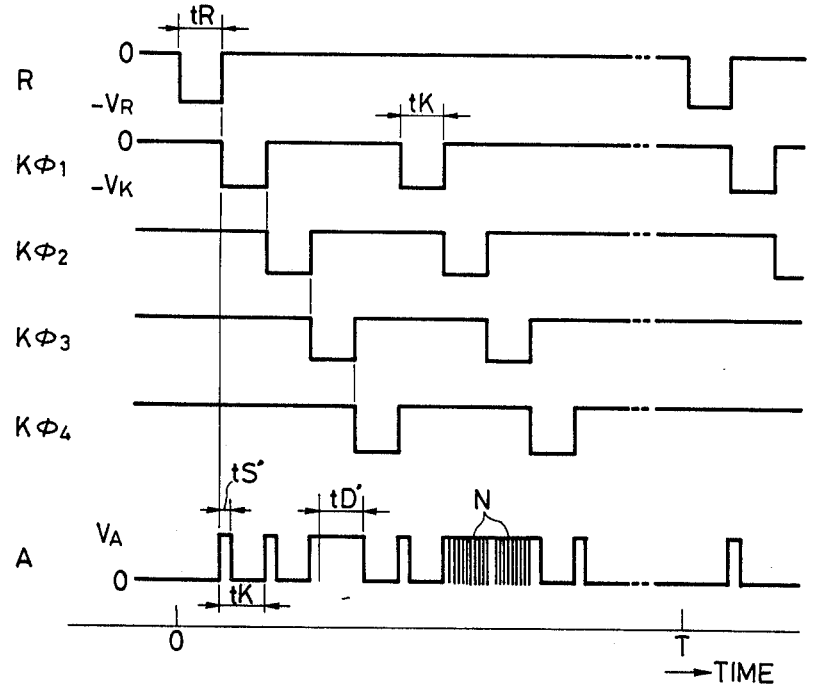
FIG. 3 PRIOR ART
FIG. 3 shows pulses that are applied to each terminal in FIG. 2.
Figure 5A:
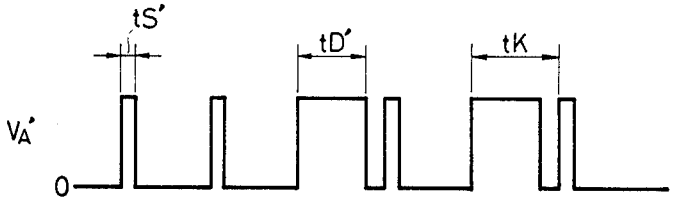
FIG. 5A shows positive display anode pulses and FIGS. 5B–5D show negative display pulses.

Each pulse in FIG. 3 is used for the positive display. That is, anode pulses in FIG. 5A are applied to the anodes 50 of the panel. As shown in the figure, the pulse width tD' of the display pulses corresponding to information display signal is larger than the width tS' of the auxiliary discharge pulses. It means that the display pulses are used for high luminance and the auxiliary discharge pulses are used for low luminance. In order to stably operate the panel at an ordinary display pulse width tD' that is about 40 μs, an auxiliary discharge pulse that is about 5 μs is necessary. Since the contrast ratio is proportional to tD'/tS' in this case, it is as small as 8:1, and this ratio must be materially improved in order to improve visibility.

Figure 5B:
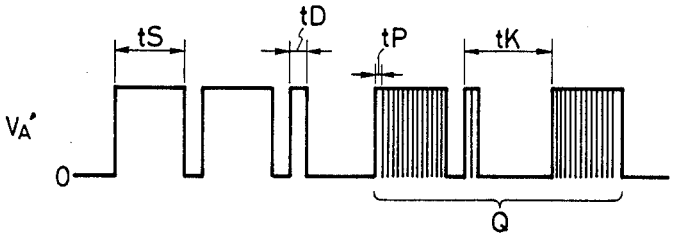
Figure 5C:
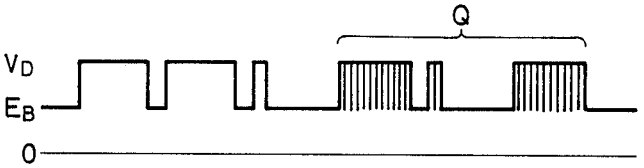
Figure 5D:
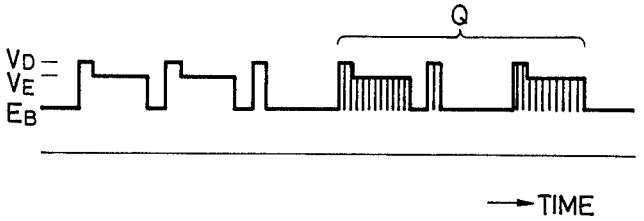

According to the present invention, anode pulses, of the type shown in FIGS. 5B–5D are applied to the anodes 50 of the panel to obtain a negative display. The part Q of the pulses in FIGS. 5B–5D will be described later. The reset and cathode pulses applied to the respective reset terminal RE and cathodes 20 are the same as shown in FIG. 3. In this case, the width tD of the display pulses is smaller than the width tS of the auxiliary discharge pulses. Therefore, the display pulses are used for low luminance and the auxiliary discharge pulses are used for high luminance. Since the number of elements which emits light is larger in the negative display, as can be seen clearly from FIG. 4B, dissociation coupling between the elements also becomes larger so that the operating voltage can be reduced (VA<VA') and tD has the relation tD<<tD'. Therefore, the display panel can be operated stably at tD=2 μs or below. The contrast ratio at this time given by tS/tD. If tS=40 μs and tD=1 μs, for example, tS/tD=40. This value is five times the typical value tD/tS=8 of the prior art technique.

When the display pattern described above is used, the number of elements which emit light with high luminance increases, so that the power consumption somewhat increases. To cope with this problem, the following counter-measures can be taken.

(1) Since a large contrast ratio can be obtained, tS (and hence, tK) is reduced (tS≧10 μs). This provides a great advantage in that it permits increasing the size of the panel.

(2) The electron energy in discharge can be optimized to excitation light emission (or vacuum ultraviolet ray radiation) by the use of narrow pulse trains (pulse width tP≦1 μs, period TP≦5 μs) for at least the auxiliary discharge pulses as shown on the right part Q of FIGS. 5B–5D.

(3) The display panel is driven with scanning pulse having a reduced amplitude, as shown in FIG. 5D.

(4) The methods (1) to (3) are combined.

When the driving method described above is used, the cataphoresis of Hg sealed to prevent the spattering of the cathode can be reduced, and the service life of the display panel can also be extended.

The amplitude of the pulse voltage can also be reduced by use of a dc bias EB as shown in FIGS. 5C and 5D in order to permit the driving circuit to be implemented in an integrated circuit arrangement.

As can be seen clearly from FIG. 4, if the element pitch is the same, the display panel of the present invention can display with a thicker line than the prior art technique, and furthermore, the angle of view can be reduced.

Figure 6:
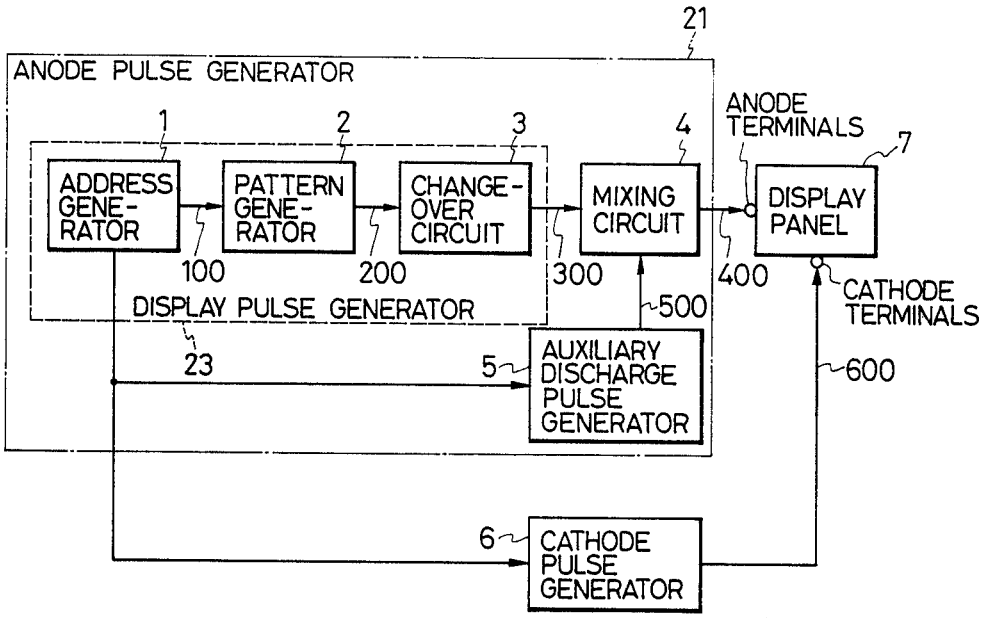
FIG. 6 shows a block diagram of the driving apparatus for changing over between positive and negative displays.

FIG. 6 shows a block diagram of the driving apparatus for changing between positive and negative displays. The driving apparatus including a cathode pulse generator 6 and an anode pulse generator 21. The anode pulse generator has a display pulse generator 23, auxiliary discharge pulse generator 5 and mixing circuit 4. The display pulse generator 23 comprises address generator 1, pattern generator 2 and changeover circuit 3. A digital address signal 100 generated by the address generator 1, which stores data corresponding to a pattern to be displayed and generates addresses, is converted to a digital pattern signal 200 corresponding to the display pattern by the pattern generator 2. The changeover circuit 3 which inverts the "1"s and "0"s of this pattern signal 200 selects either a positive or a negative signal of the pattern signal 200 as the display pulses 300.

The auxiliary discharge pulse generator 5 generates auxiliary discharge pulses 500 and applies a pulse voltage for retaining the discharge to each anode in order to make it possible to always generate a discharge on the display panel 7 in accordance with the input signal. These pulses 500 have a pulse width tS ranging from 1 to 10 μs.

The display pulses 300, which may be either a positive or negative signal, and the auxiliary discharge pulses 500 are superposed with each other by a mixing circuit 4 to prepare anode pulses 400 and these pulses 400 are supplied to each of the anode terminals of the display panel 7.

Figure 2:
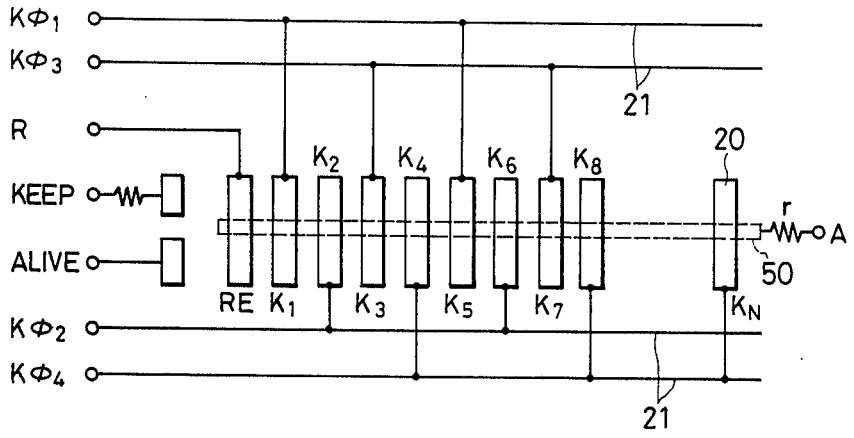
FIG. 2 PRIOR ART
FIG. 2 is a diagram showing connection between electrodes and terminals of the panel shown in FIG. 1.

The cathode pulse generator 6 generates cathode pulses 600 in a time sequential form as shown in FIG. 3, and applies them to each cathode terminals Kϕ1–Kϕ4. As shown by the panel structure of FIG. 2, the cathodes are connected to the cathode terminals in four phases, for example, and are driven in such a manner that the same cathode pulses are sequentially applied thereto. The ideal pulse width of the cathode pulses is from 30 to 100 μs.

Figure 7A:
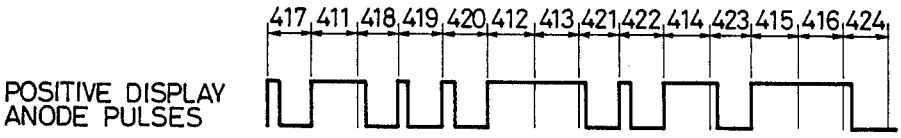
FIGS. 7A and 7B show an example of respective positive and negative display anode pulses.
Figure 7B:
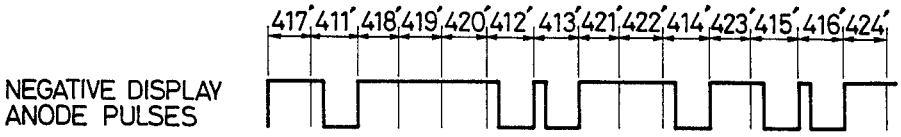

FIG. 7 shows an example of the anode pulses 400 which are composed of the display pulses 300 and the auxiliary discharge pulses 500. FIG. 7A shows the positive display anode pulses and FIG. 4B the negative display anode pulses. The pulses 411–416 of FIG. 7A, which correspond to the addresses of light emission with high luminance, are signals having a large pulse width, while pulses 417–424 which correspond to the addresses of light emission with low luminance, are the auxiliary discharge pulses alone. In contrast, the negative display pulses prepared by exchanging the high luminance signals with the low luminance signals are shown in FIG. 7B. In this case, the pulses 411'–416' are the low luminance signals and the pulses 417'–424' are the high luminance signals having a large pulse width.

Figure 8:
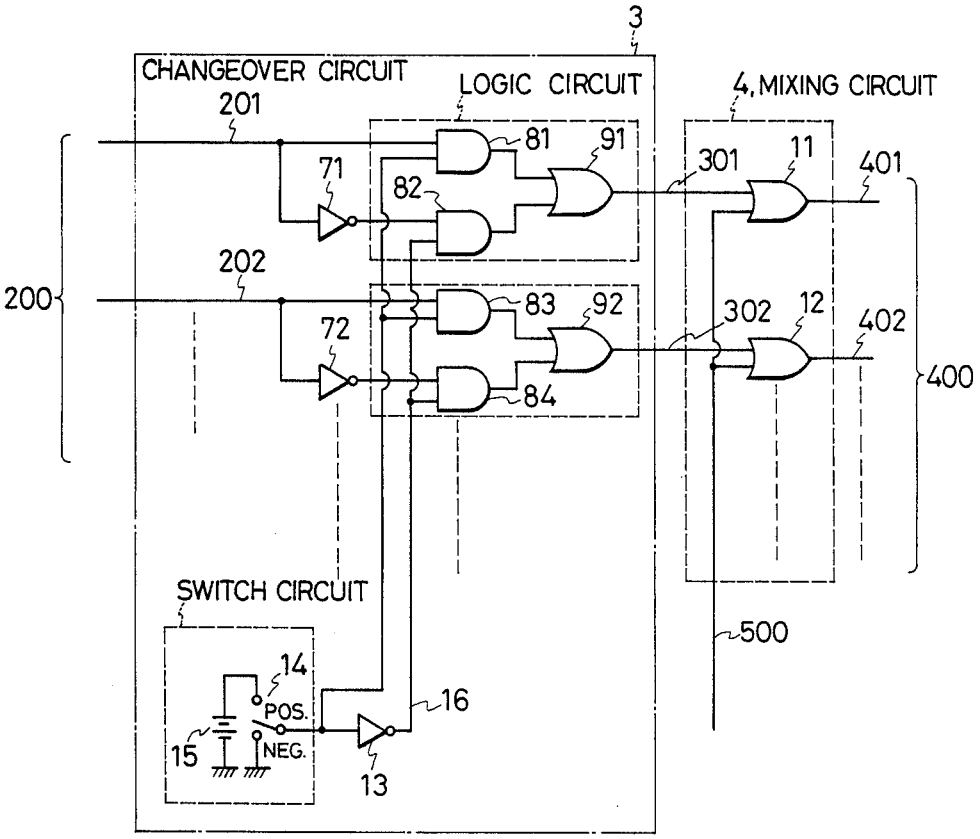
FIG. 8 shows a first embodiment of changeover and mixing circuits for use in FIG. 6.

FIG. 8 shows a first embodiment of changeover and mixing circuits 3 and 4. The pattern signals 200(201,202 . . . ) from the pattern generator 2 are digitally encoded in accordance with the pattern, and applied to AND gates 81 and 83 of two respective logic circuits. The same signals 201 and 202 are passed through inverters 71 and 72 which invert the "1"s and "0"s and the outputs of inverters 71 and 72 are applied to AND gates 82 and 84. Each inverter 71 or 72 inverts a HIGH(=1) level to a LOW(=0) level and vice versa. A switch 14 of a switch circuit changes between a HIGH level or a LOW level, and its output is applied to AND gates 81 and 83. The output of the switch 14 is inverted by the inverter 13 and the inverted output 16 is applied to AND gates 82 and 84. Each of these AND gates 81–84 is a gate circuit which produces a HIGH level signal when both of its two input terminals are at a HIGH level, and produces a LOW level signal at all other times. The output of AND gates 81 and 82 and output of AND gates 83 and 84 are applied to OR gates 91 and 92, respectively. Each OR gate 91 or 92 produces a HIGH level output when either one, or both of the two input terminals are at a HIGH level.

The AND gates 81–84, the switch 14 and the OR gates 91 and 92 constitute as a whole the selection switch for selecting between positive display and negative display. When the switch 14 is connected to battery 15 to obtain a HIGH level, pattern signals 201 and 202 produce positive display pulses 301 and 302, and when the switch 14 is connected to ground to give a LOW level, the inverted pattern signals obtained by inverters 71 and 72 produced negative display pulses 301 and 302. The signal thus selected for positive or negative display enters the OR gates 11 or 12 of the mixing circuit 4 and is then mixed with the auxiliary discharge pulses 500, thereby forming anode pulses 400(401,402 . . . ).

Figures 9, 10:
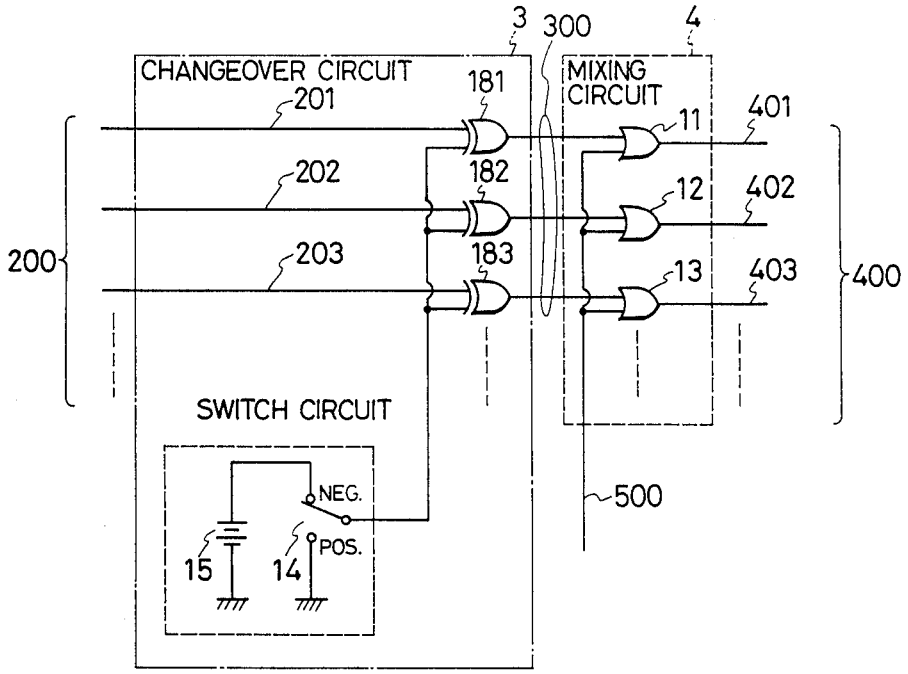
FIG. 9 shows another embodiment of changeover and mixing circuits for use in FIG. 6.
FIG. 10 shows the truth table for an Exclusive OR gate.

FIG. 9 shows another embodiment of the changeover and mixing circuits 3 and 4. The pattern signals 200(201, 202 . . . ) from the pattern generator 2 are encoded digitally in accordance with the pattern, and are applied to Exclusive OR gates 181, 182 and 183. An Exclusive OR gate is one that produces a LOW(=0) level when its two inputs are both LOW or both HIGH levels and a HIGH (=1) level when one input at a LOW and the other at a HIGH level.

FIG. 10 shows a truth table for an Exclusive OR gate. This characteristics can be utilized as follows. If the INPUT 2 is set to the LOW level, for example, the output becomes the same as the INPUT 1, and if the INPUT 2 is set to the HIGH level, the resulting output is the same as the inverted value of the INPUT 1. This change of the INPUT 2 is effected by the switch 14. When the switch 14 is grounded and is set to the LOW level, the outputs of the Exclusive OR gates 181–183 become the same as the pattern signals 201–203, thereby effecting a positive display. When the switch 14 is connected by the batteries 15 to the HIGH level, the outputs of the Exclusive OR gates 181–183 become the inverted values of the pattern signals 201–203, thereby effecting a negative display.

The display pulses 300 after selection for positive or negative display then enter the OR gates 11–13 and are then mixed with the auxiliary discharge pulses 500 and turn into the anode pulses 401–403.

Figure 1:
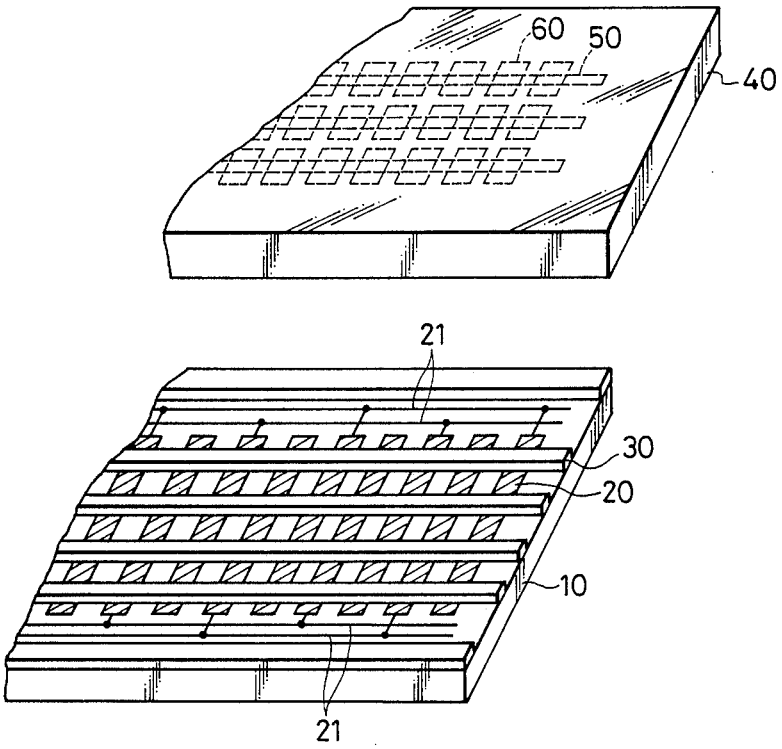
FIG. 1 PRIOR ART
FIG. 1 is a perspective view showing the principle of a typical display panel to which the present invention is applied.
Figure 11:
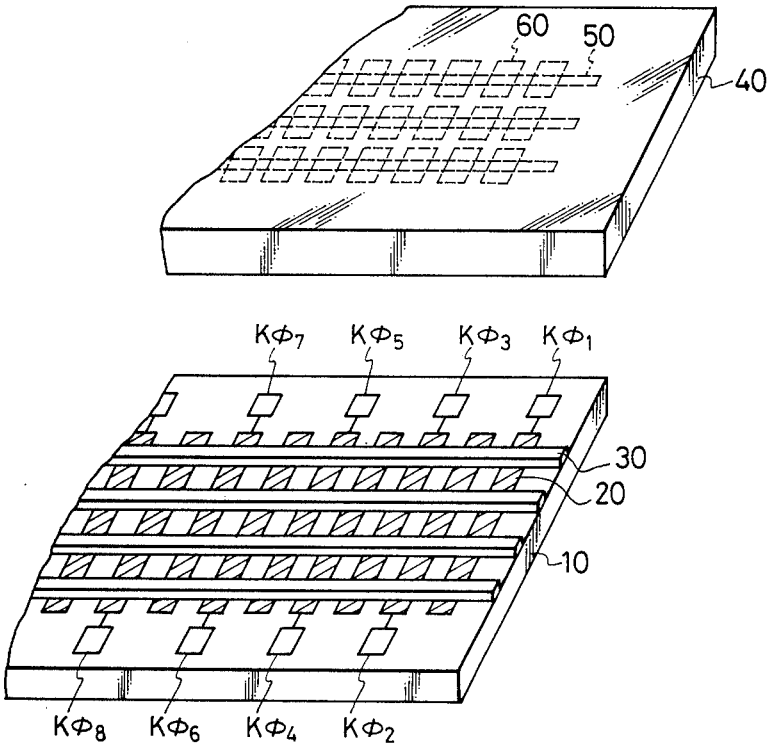
FIG. 11 is a perspective view showing another structure of a display panel to which the present invention may be applied.
Figure 12:
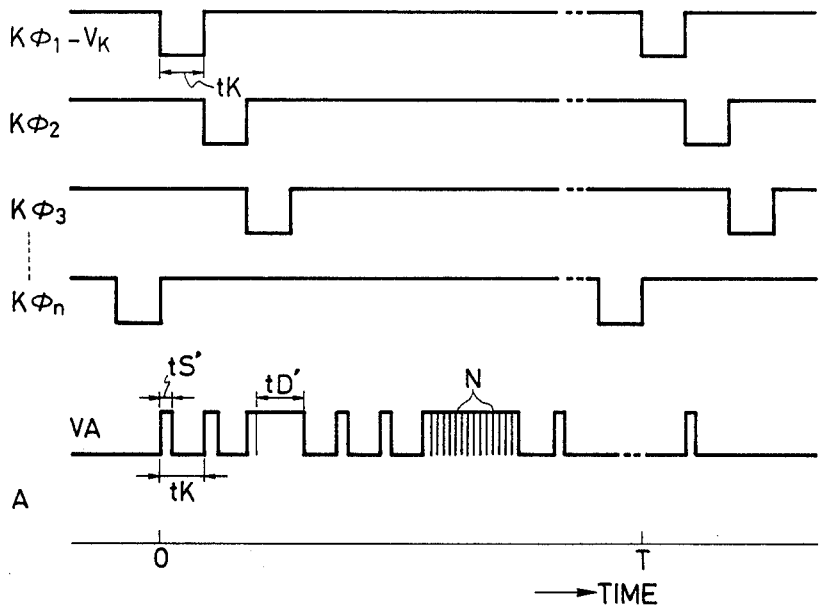
FIG. 12 shows cathode and positive display anode pulses that are applied, to each electrodes in FIG. 11.
Figure 13:
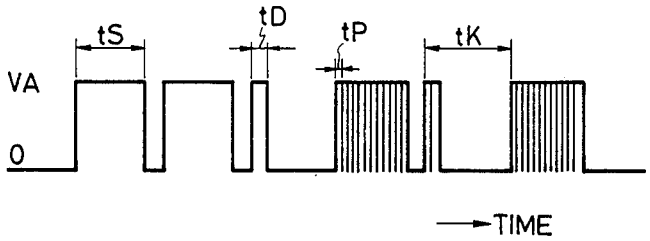
FIG. 13 shows negative display pulses that are applied to each anode electrode in FIG. 11.

Additionally, the present invention is applicable to other panels, for example, a panel as shown in FIG. 11. The structure of this panel is basically the same as shown in FIG. 1, but the connection of the cathodes between two panels is different. That is, the cathodes of FIG. 11 are connected to respective terminals Kϕ1–KϕN, and cathodes of FIG. 1 to form terminals Kϕl–Kϕ4. Therefore, cathode pulses as shown FIG. 12 are applied to the terminals Kϕl–KϕN, respectively. The reset pulse (not shown) and anode pulses are the same as shown in FIG. 3 and FIG. 5. That is, the anode pulses of FIG. 12 are used for the positive display and FIG. 13 for the negative display.

What is claimed is:

1. A driving apparatus for a gas discharge display panel;

said display panel comprising:

a plurality of parallel cathodes arranged on a substrate and connected by polyphase wiring;

a plurality of parallel barrier ribs disposed on said cathodes in such a manner as to cross said cathodes at right angles;

a plurality of parallel anodes disposed on a transparent face plate in parallel with said barriers;

a driving circuit comprising:

a cathode pulse generator providing cathode pulses at its output, said output being coupled to said cathodes;

an anode pulse generator providing anode pulses at its output, said output being coupled to said anodes, said anode pulse generator including a display pulse generator for generating display pulses;

an auxiliary discharge pulse generator for generating auxiliary discharge pulses; and a mixing circuit mixing said display pulses and auxiliary discharge pulses, said display pulse generator including an address generator for generating a digital address signal, a pattern generator for converting said digital address signal to a digital pattern signal corresponding to a display pattern, and a changeover circuit for selecting one of said digital pattern signal and its inverted signal as said display pulses;

said changeover circuit including a switching circuit, a plurality of logic circuits each including a first AND gate, a second AND gate, an OR gate, a first inverter and a second inverter, said inverters having as respective inputs said digital pattern signal and a signal from said switching circuit, said first AND gate having as inputs said digital pattern signal and said signal from said switching circuit, and said second AND gate having as inputs the outputs of said first and second inverters, and said OR gate having as inputs the outputs of said first and second AND gates and providing said display pulses at its output.

2. A driving apparatus for a gas discharge display panel as in claim 1, wherein said anode pulses are provided in narrow pulse trains.

3. A driving apparatus for a gas discharge display panel as in claim 1, wherein said anode pulses have a d.c. bias for reducing the amplitude of the pulse voltage.

4. A driving apparatus for a gas discharge display panel;

said display panel comprising:

a plurality of parallel cathodes arranged on a substrate and connected by polyphase wiring;

a plurality of parallel barrier ribs disposed on said cathodes in such a matter as to cross said cathodes at right angles; and a plurality of parallel anodes disposed on a transparent face plate in parallel with said barriers;

a driving circuit comprising:

a cathode pulse generator providing cathode pulses at its output, said output being coupled to said cathodes;

an anode pulse generator providing anode pulses at its output, said output being coupled to said anodes, said anode pulse generator including a display pulse generator for generating display pulses;

an auxiliary discharge pulse generator for generating auxiliary discharge pulses; and a mixing circuit mixing said display pulses and auxiliary discharge pulses, said display generator including an address generator for generating a digital address signal, a pattern generator for converting said digital address signal to a digital pattern signal corresponding to a display pattern, and a changeover circuit for selecting one of said digital pattern signal and its inverted signal as said display pulses; said changeover circuit comprising a plurality of exclusive OR gates and a switching circuit, said respective exclusive OR gates having as inputs said digital pattern signal and a signal from said switching circuit, and providing said display pulses at its output.

5. A driving apparatus for a gas discharge display panel as in claim 4, wherein said anode pulses are provided in narrow pulse trains.

6. A driving apparatus for a gas discharge display panel as in claim 4, wherein said anode pulses have a d.c. bias for reducing the amplitude of the pulse voltage.

* * * * *